US005556512A

United States Patent [19]

Graf

[11] Patent Number: 5,556,512

[45] Date of Patent: Sep. 17, 1996

[54] BEAM FOR A PAPER MAKING MACHINE FRAME

[75] Inventor: Edwin X. Graf, Menasha, Wis.

[73] Assignee: Voith Sulzer Papiermaschinen GmbH, Heidenheim, Germany

[21] Appl. No.: 379,846

[22] Filed: Jan. 27, 1995

Related U.S. Application Data

[63] Continuation of Ser. No. 57,123, May 3, 1993, abandoned.

[51] Int. Cl.[6] ..... D21F 7/00

[52] U.S. Cl. ..... 162/272; 162/273; 52/573.1

[58] Field of Search ..... 162/272, 273, 162/274; 52/727, 573.1

[56] References Cited

U.S. PATENT DOCUMENTS

| | | | |
|---|---|---|---|
| 3,675,376 | 7/1972 | Belew | 52/573.1 |
| 4,560,441 | 12/1985 | Kraft | 162/273 |
| 5,084,138 | 1/1992 | Ewld | 162/352 |
| 5,164,048 | 11/1992 | Bossen et al. | 162/272 |

*Primary Examiner*—Karen M. Hastings
*Attorney, Agent, or Firm*—Taylor & Associates, P.C.

[57] ABSTRACT

A cross beam in a papermaking machine frame, having a specific overall length is composed of three nested beam elements, namely an outer beam element, a middle beam element and an inner beam element. The middle beam element is at its one end rigidly connected with the outer beam element and on its other end with the inner beam element. The material of the middle beam element, for instance aluminum, has approximately twice the coefficient of thermal expansion as compared to the material of the other beam elements, for instance steel. Therefore, the overall length of the beam remains essentially unchanged if a temperature change entails a length change of the beam elements.

10 Claims, 1 Drawing Sheet

BEAM FOR A PAPER MAKING MACHINE FRAME

This is a continuation of application Ser. No. 08/057,123, filed May 3, 1993, now abandoned.

BACKGROUND OF THE INVENTION

The invention concerns a beam, and in particular a cross beam for a papermaking machine frame. For instance in paper-making machines or machines for the processing of webs of paper, textiles or plastics, there are numerous rolls, cylinders or the like involved which serve the treatment and/or guidance of the running web and are installed in a machine frame. Any machine of this type comprises tending side frame parts and drive side frame parts. To stiffen the entire machine frame, it is at some points necessary to join the tending side frame parts by means of a cross beam to the drive side frame part.

The length of such a cross beam depends on the web width, which may be in the order of 5–10 meters. Hence, the length of the cross beam in such instance may amount to more than 10 m. Such a cross beam is typically tubular or box-shaped and made of steel. It is known that considerable temperature fluctuations may occur in such a machine during its operation. As a result, each of the cross beams undergoes a change in length, producing undesirable bending moments in the frame parts on the tending and drive sides.

Therefore, the problem underlying the invention is to provide a beam, for instance a cross beam for a machine frame whose length changes minimally at temperature fluctuations.

SUMMARY OF THE INVENTION

This problem is solved by the features of the present invention. The beam according to the invention is composed of three beam elements, namely of two so-called partial beams of which each can be coupled, by means of a so-called interface, to one of the two components (for instance frame parts) to be connected with each other. Among themselves, the two partial beams are connected by means of a so-called coupling beam, and at that, each at a so-called coupling point. It is essential that the three beams overlap, so that on each of the two partial beams the coupling point will be situated in the vicinity of the opposite component, i.e., in the vicinity of that component to which the partial beam cannot be coupled.

It is also essential that a thermal length change of each partial beam take place in such a way that its interface (with which it can be coupled to one of the two components) retains its position, whereas the said coupling point moves by the entire thermal length change. For instance at a temperature increase, the entire thermal expansion of each of the partial beams takes place exclusively toward the coupling point, that is, on the one partial beam in the one direction and on the other partial beam in the opposite direction. The distance between the two coupling points increases in the process by the sum of the thermal expansion of the two partial beams. This becomes possible because the coupling beam—according to the invention—is fabricated of a material whose coefficient of thermal expansion is considerably greater than that of the two partial beams.

Owing to the features of the present invention, the distance between the two interfaces—at least at rough approximation—remains unchanged, despite a thermal length change of the beam elements. Thus a considerable advantage that is achieved is that the beam generates at temperature fluctuations only very slight bending moments in the components to be connected with one another. In favorable cases, such bending moments are avoided completely.

In one preferred form of the present invention, all three beam elements are arranged parallel to one another. However, a variation thereof is possible as well; it is for instance conceivable to arrange only the two partial beams parallel to each other and at a certain distance from each other. In this case, the coupling beam extends slanted from one to the other partial beam.

According to another favorable embodiment of the invention, the beam elements are nested in telescope fashion. For that purpose they are made preferably of tubular stock. In variation thereof, however, they may also be fashioned as box-shaped hollow beams.

As already mentioned, the inventional beam must frequently bridge a very large distance between the two components to be connected with each other. In this case, the two partial beams suitably bear in the area of their movable ends on the opposite component, for instance by means of an axial guide. As a further development of the invention, the said axial guide can on each beam end be arranged near the respective coupling point or fitted to it.

Regarding the materials, it is especially favorable to fabricate the two partial beams of steel and the coupling beam of a light alloy, preferably aluminum. This makes it possible to utilize the fact that the coefficient of thermal expansion of many light alloys is about twice as large as that of steel.

BRIEF DESCRIPTION OF THE DRAWINGS

The above-mentioned and other features and advantages of this invention, and the manner of attaining them, will become more apparent and the invention will be better understood by reference to the following description of the invention taken in conjunction with the accompanying drawings, wherein.

Corresponding reference characters indicate corresponding parts throughout the several views. The exemplification set out herein illustrates a preferred embodiment of the invention, and such exemplifications is not to be construed as limiting the scope of the invention in any manner.

DETAILED DESCRIPTION OF THE INVENTION

Figure 1:
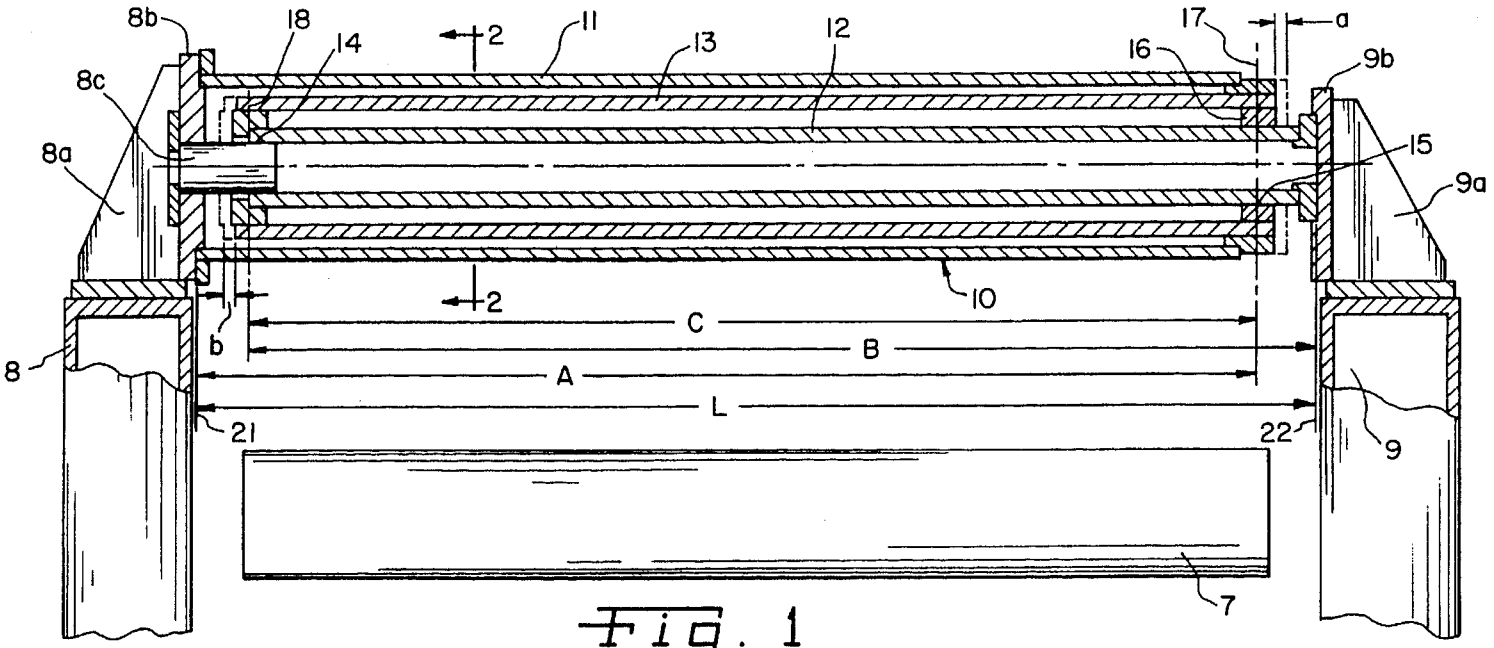
FIG. 1 shows in longitudinal section a beam serving to connect two components.
Figure 2:
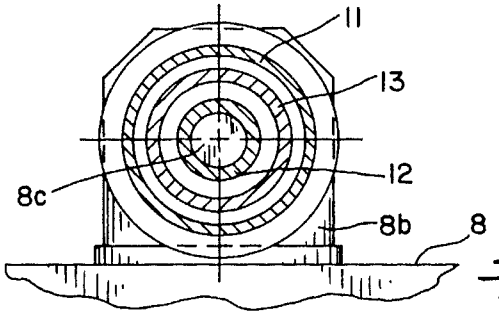
FIG. 2 shows a cross section along line II in FIG. 1.

FIG. 1 shows a partial view of a first component 8 and a second component 9. First and second components 8, 9 are, for instance, a frame part on the tending side and a frame part on the drive side of a paper machine. A roll 7 is installed between first and second frame components 8 and 9. A console 8*a*, 9*a*, each with a vertical flange 8*b*, 9*b* is rigidly secured to each of these frame parts. Beam 10 is composed essentially of three nested tubular beam elements 11, 12, 13, and extends from one flange to the other.

In detail, the beam 10 comprises a first outer partial beam 11 which by way of the console 8*a* is rigidly connected to the first component 8 and extends up close to the flange 9*b* of the second component 9. Second partial beam 12 is rigidly connected to the flange 9*b* and extends up close to the flange 8*b* of the opposite component 8. Fitted to the flange 8*b* is a journal 8*c* forming an axial guide 14 for the second partial beam 12.

Inserted between the two partial beams 11 and 12 is a tubular coupling beam 13 which with its end is rigidly secured, at the first coupling point 17, to the "free" end of the first partial beam 11. At this first coupling point 17, a sliding bushing 16 is inserted in the interior of the coupling beam 13, forming together with the second partial beam 12 an axial guide 15 for the first partial beam 11. The other end of the coupling beam 13 is rigidly connected to the free end (bearing on the journal 8*c*) of the second partial beam 12. The coupling point provided there (second coupling point) is referenced 18.

The two partial beams 11 and 12 are fabricated of steel pipes, whereas the coupling beam 13 is made of aluminum pipe. The dimension L (total length of beam 10) indicates the distance between the two interfaces 21 and 22. On the interface 21, the first partial beam 11 is secured to the component 8, whereas at the interface 22 the second partial beam 12 is secured to the second component 9.

It is important that at a temperature change the overall length L of the beam 10 remains maximally exactly unchanged. A possible thermal expansion of the beam elements 11–13 is illustrated in FIG. 1, as an example, by dashed lines.

Allowing for the given coefficients of thermal expansion for steel, for one, and for light alloy (for instance aluminum), for another, and with a given temperature difference, the following should be noted:

Due to the thermal expansion of the first partial beam 11, the distance A of the first coupling point 17 from the first interface 21 increases by the dimension a. Owing to a simultaneous thermal expansion of the second partial beam 12, the distance of the second coupling point 18 from the second interface 22 increases by the dimension b. The length changes a and b will normally be equal. It is essential to ensure that the thermal expansion of the coupling beam 13 will at the same time be such that the distance C between the two coupling points 17 and 18 increases as exactly as possible to the dimension a+b. To accomplish this, the ratio between the distance C and the sum of the distances A+B must as exactly as possible be adapted to the ratio between the coefficients of thermal expansion of steel, for one, and the light alloy used, for another.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A paper-making machine for the production of a fibrous material web, said paper-making machine including at least one of a rotatable roll and rotatable cylinder operably associated with said web and installed in a machine frame, said paper-making machine frame comprising:

a first frame component and a second frame component, the first frame component comprising one of a tending side frame component and a drive side frame component, and the second frame component comprising an other of the tending side frame component and the drive side frame component;

a cross beam connecting said first frame component with said second frame component and structured to stiffen the paper-making machine frame, said beam including:

a first partial beam coupled to the first frame component, said first partial beam being coupled to said first frame component at a first interface;

a second partial beam coupled to the second frame component, said second partial beam being coupled to said second frame component at a second interface, said second partial beam overlapping the first partial beam; and a coupling beam, said coupling beam being coupled to said first partial beam at a first coupling point and to said second partial beam at a second coupling point;

said first coupling point being situated closer to the second frame component than to the first frame component, and the second coupling point being situated closer to the first frame component than to the second frame component;

said partial beams and said coupling beam each having a coefficient of thermal expansion, wherein the coefficient of thermal expansion of the coupling beam is greater than the coefficient of thermal expansion of each of the two partial beams; the two interfaces being stationary during thermal length change of the partial beams and the coupling beam, and the coupling points being movable during said thermal length change;

the partial beams being positioned such that the first partial beam bears movably on the second frame component, and the second partial beam bears movably on the first frame component; the first partial beam bearing movably on the second frame component by means of an axial guide comprising a sliding bushing, and the second partial beam bearing movably on the first frame component by means of an axial guide comprising a journal.

2. The paper-making machine according to claim 1, in which dimension A represents the distance from the first interface to the first coupling point, dimension B represents the distance from the second interface to the second coupling point, dimension C represents the distance from the first coupling point to the second coupling point, dimension a represents the increase in dimension of A due to thermal length change of the first partial beam, and dimension b represents the increase in dimension of B due to the thermal length change of B, wherein the dimensions A, B and C, and the materials comprising the partial beams and the coupling beam are related such that a thermal change of dimension C is at least approximately equal to the sum of thermal changes a and b.

3. The paper-making machine according to claim 1, wherein the two partial beams and the coupling beam are arranged parallel to one another.

4. The paper-making machine according to claim 2, wherein the two partial beams and the coupling beam are arranged parallel to one another.

5. The paper-making machine according to claim 3, in which at least the first partial beam and the coupling beam have hollow elements, said beams being arranged such that the second partial beam extends through the interior of the coupling beam, and the coupling beam extends through the interior of the first partial beam.

6. The paper-making machine according to claim 1, wherein the partial beams and the coupling beam are fabricated of tubular stock.

7. The paper-making machine according to claim 5, wherein the partial beams and the coupling beam are fabricated of tubular stock.

8. The paper-making machine according to claim 1, wherein at least one of the coupling points is arranged in closely spaced relationship with one of the said axial guides.

9. The paper-making machine according to claim 1, wherein the partial beams are fabricated of steel, and the coupling beam is made of a lightweight alloy.

10. The paper-making machine according to claim 9, wherein the lightweight alloy consists essentially of aluminum.

* * * * *